US008938937B2

(12) United States Patent
Boldrini et al.

(10) Patent No.: US 8,938,937 B2
(45) Date of Patent: Jan. 27, 2015

(54) MACHINE AND METHOD FOR PACKAGING FIBER MATERIAL

(75) Inventors: Fulvio Boldrini, Ferrara (IT); Roberto Ghiotti, Calderino di Monte San Pietro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 674 days.

(21) Appl. No.: 13/168,010

(22) Filed: Jun. 24, 2011

(65) Prior Publication Data

US 2012/0000164 A1 Jan. 5, 2012

(30) Foreign Application Priority Data

Jun. 30, 2010 (IT) ..... BO2010A0422

(51) Int. Cl.
*B65B 63/02* (2006.01)
*B65B 1/24* (2006.01)
*B65B 29/00* (2006.01)

(52) U.S. Cl.
CPC . *B65B 1/24* (2013.01); *B65B 29/00* (2013.01); *B65B 63/02* (2013.01); *B65B 2210/06* (2013.01)
USPC ..... 53/529; 53/438; 53/523

(58) Field of Classification Search
CPC ..... B65B 1/24; B65B 63/02; B65B 29/00; B65B 43/60; B65B 19/025; B65B 19/14; B65B 19/20
USPC ..... 53/148, 149, 150, 444, 438, 529, 523, 53/228, 234, 469, 252, 253
See application file for complete search history.

(56) References Cited

U.S. PATENT DOCUMENTS

| | | | | | |
|---|---|---|---|---|---|
| 3,911,643 | A | * | 10/1975 | Davies | 53/170 |
| 4,318,264 | A | * | 3/1982 | Rewitzer | 53/436 |
| 5,074,101 | A | * | 12/1991 | Rewitzer | 53/436 |
| 5,174,088 | A | * | 12/1992 | Focke et al. | 53/431 |
| 5,425,215 | A | * | 6/1995 | Lewis et al. | 53/170 |
| 5,465,554 | A | * | 11/1995 | Lewis et al. | 53/438 |

(Continued)

FOREIGN PATENT DOCUMENTS

| | | |
|---|---|---|
| DE | 1034092 | 7/1958 |
| EP | 2103529 | 9/2009 |
| GB | 864065 | 3/1961 |

OTHER PUBLICATIONS

Italian Search Report dated May 26, 2011 from related foreign application.

*Primary Examiner* — Andrew M Tecco
(74) *Attorney, Agent, or Firm* — Timothy J. Klima; Shuttleworth & Ingersoll, PLC

(57) ABSTRACT

A machine for packaging fiber material comprises feed means (2) supplying predetermined portions of fiber material (3) in an ordered succession, compacting means (4) by which the portions of fiber material (3) are compacted initially, a feed station (8) to which packs (9) are supplied for filling with the fiber material (3), a filling station (D) at which the fiber material (3) is inserted into the packs (9), and a closure station (E) located downstream of the filling station (D), at which the filled packs (9) are sealed. The machine further comprises fiber material (3) compressing and forming means (7) by which each of the portions of fiber material (3) is maintained in a state of compression downstream of the compacting means (4) for a prescribed interval of time, in such a way that the selfsame portion of fiber material (3) is caused to assume a compact geometry of tablet-like form prior to its insertion into the respective pack (9).

12 Claims, 4 Drawing Sheets

(56) References Cited

U.S. PATENT DOCUMENTS 6,044,624 A * 4/2000 Focke et al. ..... 53/438
7,937,916 B2 * 5/2011 Thierig et al. ..... 53/562
8,074,428 B2 * 12/2011 Hoppe et al. ..... 53/438
2009/0193762 A1 * 8/2009 Thierig et al. ..... 53/455
2010/0058714 A1 * 3/2010 Hoppe et al. ..... 53/438

* cited by examiner

MACHINE AND METHOD FOR PACKAGING FIBER MATERIAL

This application claims priority to Italian Patent Application BO2010A000422 filed Jun. 30, 2011, the entirety of which is incorporated by reference herein.

BACKGROUND OF THE INVENTION

This invention relates to a machine and a method for packaging fiber material.

This invention can be advantageously be applied to the packaging of fiber material, preferably loose tobacco, to which this description will hereinafter refer but without thereby limiting the scope of the invention.

The packs which the tobacco is inserted into generally comprise a pouch-like containing portion which is sealed along a line transversal to the axis of symmetry of the pack, and a flap which protrudes from the open side of the pouch and which can be folded over the containing portion in such a way as to guarantee a better seal and protection for the contents of the pack.

The pouch, which is sealed to hold in the tobacco aroma, also has suitable opening/closing systems designed to keep it well sealed at all times and to prevent the tobacco from deteriorating and losing its aroma as a result of oxidation and exposure to humidity and air.

In prior art machines for packaging loose tobacco, suitably treated and measured tobacco portions are fed in an ordered succession to a book-like device designed to press the mass of tobacco before inserting it into the packs.

The tobacco portions drop into the device, which is substantially a press which folds closed temporarily in book-like fashion on the mass of tobacco. Basically, the device reduces the dimensions of the tobacco. In effect, during this operation, the tobacco is pressed and immediately pushed into the pack.

A pusher element channels the tobacco into the pack, which is held open vertically under the compacting device, and further compresses the tobacco into it.

The pusher element then withdraws to allow sealing means to close the pack.

Alternatively, the packs are rested on a rotary carousel having a plurality of locations where the packs are held and filled with a measured quantity of tobacco.

The open packs are fed to the carousel, the tobacco is placed on the open flap and suitable carrier elements, located along the path followed by the rotary unit, insert the tobacco into the packs.

Next, the carousel passes through a sealing station where the packs are closed.

The solutions adopted by the prior art have some disadvantages.

In particular, the production lines currently in use present stretches on which the tobacco advances freely, without being controlled or guided. The stretches where the mass of tobacco is gravity fed inevitably slow down the production process waiting for the tobacco to fall.

Also, during gravity feed, the smallest, volatile particles of tobacco tend to scatter, causing material to be lost and leading to weight errors in the quantity of tobacco actually inserted into the packs.

Another major drawback is linked to the way the packs are sealed. In other words, during the step of inserting the tobacco into the pack, specific elements push the tobacco to the bottom of the pack, simultaneously compressing it, and then withdraw, tending to drag some of the fibers of material away with them.

The fibers that are dragged away from the mass of tobacco when the pushing element withdraws are trapped in the sealing line.

This inevitably means a waste of tobacco but more than that, reduces the quality of the packed tablet as a whole.

In effect, the seal is no longer uniform but presents small gaps along the seal which can no longer guarantee the optimum conditions for preserving the tobacco.

Through these gaps, the tobacco gradually loses parts of its flavor and aroma, is constantly exposed to humidity and is oxidized by the air.

Thus, from the time it is packaged to when it is sold, the tobacco inevitably deteriorates, which means the product sold is of poorer quality.

SUMMARY OF THE INVENTION

The aim of this invention is to provide a machine and method for packaging fiber material which overcome the disadvantages of the prior art.

More specifically, the aim of this invention is to provide a machine for packaging fiber material which can guarantee a perfect pack seal, a high level of tobacco protection and extended shelf life.

Another aim of this invention is to provide a machine for packaging fiber material which can reduce packaging times.

This invention accordingly provides a machine and a method for packaging fiber material in accordance with what is claimed in one or more of the appended claims.

BRIEF DESCRIPTION OF THE DRAWINGS

The invention will now be described with reference to the accompanying drawings which illustrate a preferred embodiment of it and in which.

DESCRIPTION OF THE PREFERRED EMBODIMENTS

Figure 1:
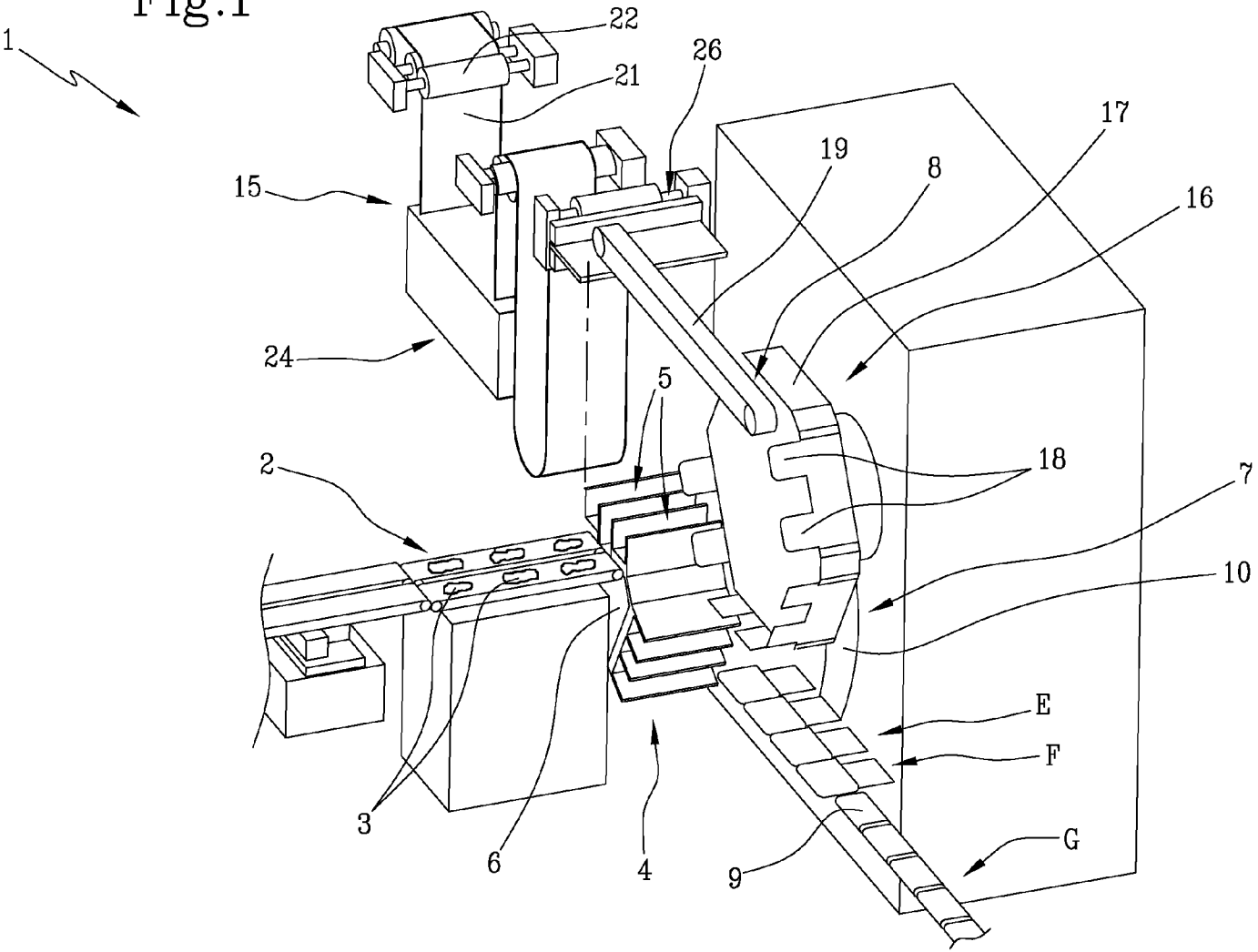
FIG. 1 is a schematic perspective view of the machine for packaging fiber material according to this invention.

With reference to FIG. 1, the numeral 1 denotes in its entirety a machine for packaging fiber material according to this invention.

The machine 1 comprises feed means 2 supplying predetermined portions of fiber material 3 in an ordered succession and a feed station 8 to which packs 9 are supplied for filling with the fiber material. These portions of fiber material 3, such as, for example, loose tobacco, to which express reference will hereinafter be made but without thereby limiting the scope of the invention, come from forming, metering and weighing units located upstream of the feed means 2.

The portions of fiber material 3 are directed by the feed means 2 to compacting means 4 by which these portions are compacted initially.

Figure 3:
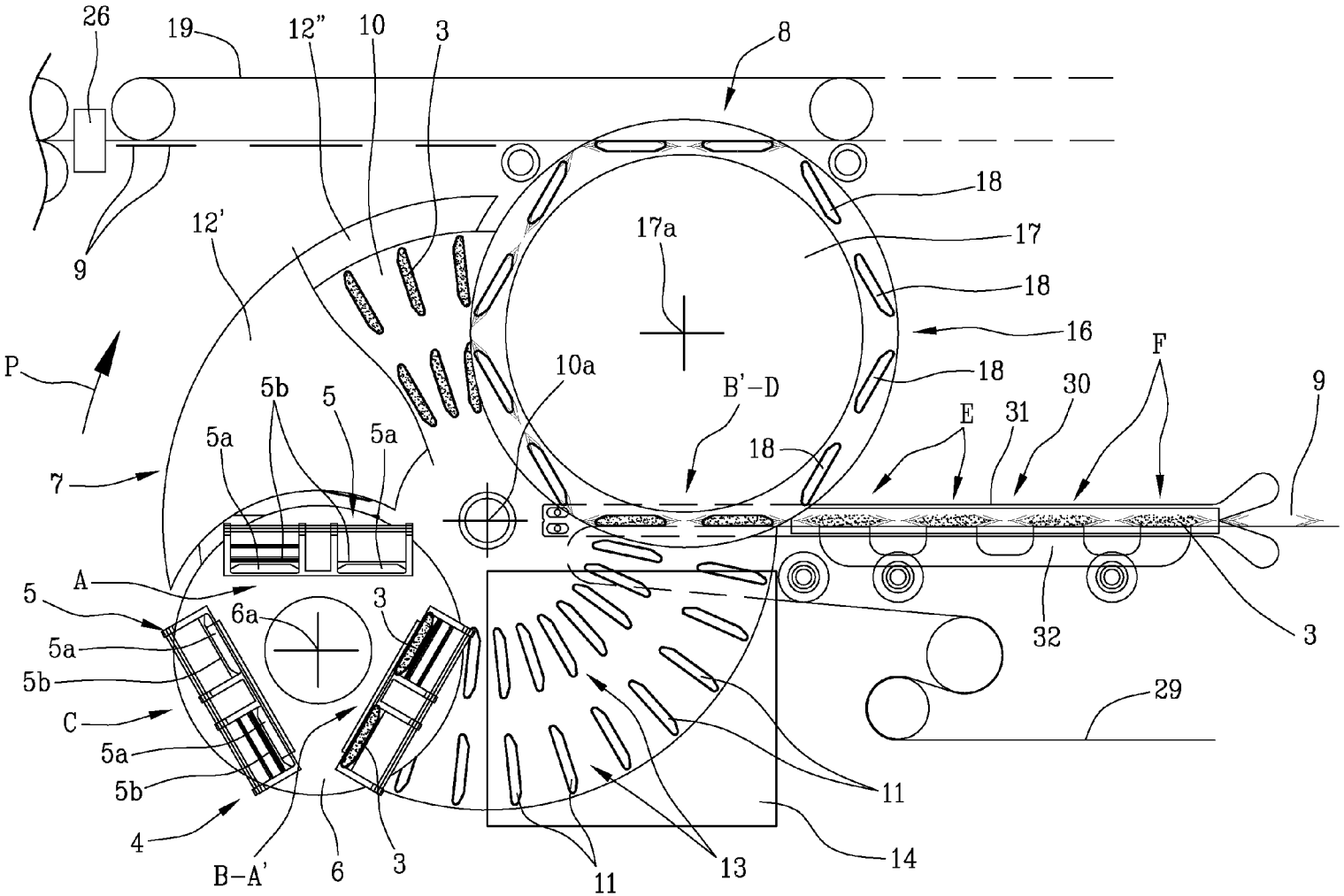
FIG. 3 shows an enlargement of a portion of the machine illustrated in FIG. 2.
Figure 4:
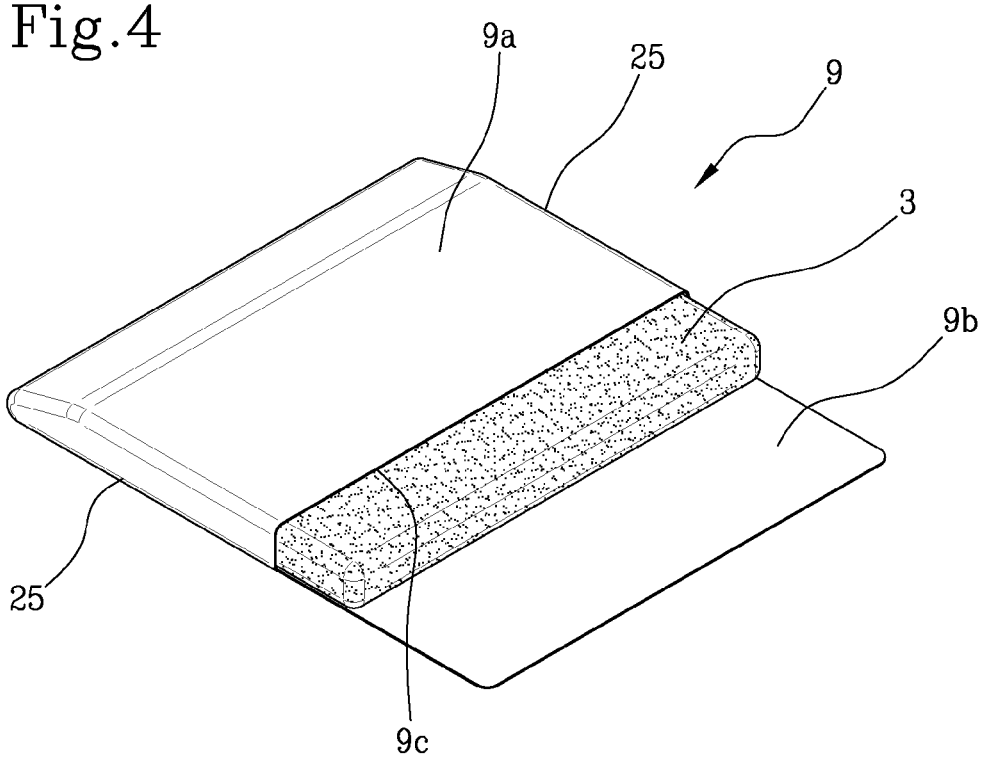
FIG. 4 is a perspective view of an open pack containing fiber material.
Figure 5:
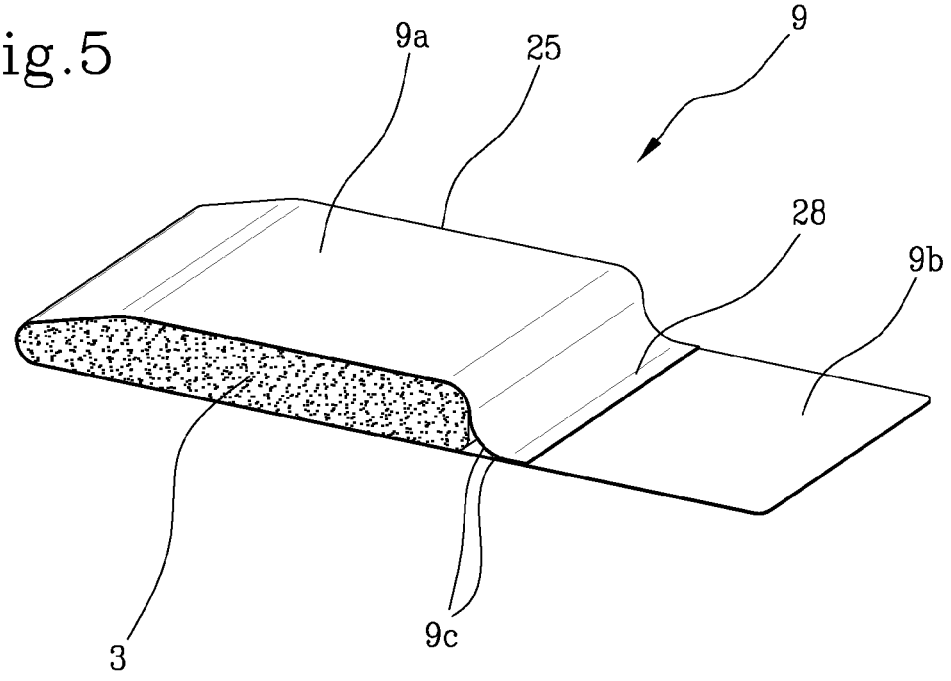
FIG. 5 is a perspective cutaway view of a partly closed pack containing fiber material.

More in detail, the compacting means 4 comprise at least one box 5 presenting a compartment 5*a*, and a lid 5*b* hinged to the compartment 5*a* (see FIG. 3).

Each portion of loose tobacco is inserted into the box 5 and compacted when the lid 5*b* is closed.

The boxes 5 are open at the front and at the back. This allows the tobacco to be slidably inserted into the compartment 5*a* by the pushing action of specific pushers, not illustrated.

The compacting means 4 also comprise a support 6 rotatable about a respective, preferably horizontal axis 6*a*, and a plurality of boxes 5 mounted to the selfsame support.

The boxes 5 are advantageously distributed in groups round the periphery of the rotatable support 6; there is preferably at least one group of boxes 5 and each group has at least two boxes 5.

A preferred configuration, illustrated in the accompanying drawings, comprises a rotatable support 6 to which three groups of boxes 5 are mounted, each group having at least two boxes 5.

Both the number of groups of boxes 5 and the number of boxes in each group may vary according to the tobacco feed lines the machine is equipped with or based on the production speed desired.

As they travel along their circular path, the boxes 5 pass through a loading station A at which the portions of fiber material 3 are received from the feed means 2, an unloading station B at which the portions of fiber material 3 are released to compressing and forming means 7, and a reject station C at which any portions of fiber material 3 not responding to selected parameters are discarded.

It should be noted that the compressing and forming means 7 maintain the portions of fiber material 3 in a state of compression in such a way that the selfsame portions are caused to assume a compact shape.

The discarded material is recovered and again directed to a tobacco forming unit upstream.

At the unloading station B, there are pusher means, not illustrated, designed to assist the removal of the portion of fiber material 3 from each box 5, and the insertion of the selfsame portion into a respective pocket 11 of the compressing and forming means 7.

More specifically, the machine 1 comprises fiber material 3 compressing and forming means 7, located upstream and by which each of the portions of fiber material 3 from the compacting means 4 is maintained in a state of compression for a prescribed interval of time. Advantageously, the interval of time for which the portions of loose tobacco material 3 remain compressed is between 10 and 25 seconds, and preferably between 13 and 20 seconds. That way, each portion of tobacco 3 is caused to assume a compact geometry of tablet-like form prior to its insertion into the respective pack 9.

The tobacco thus takes a three-dimensional shape substantially like that of a parallelepiped, with two opposite faces which are larger than the four lateral faces which are elongate and flattened.

The loose tobacco has the property of keeping its compressed configuration for a certain length of time before expanding again. In other words, the tobacco subjected to compression tends to return to its original size after a length of time that depends on the duration of the pressure applied to it previously.

More specifically, the longer the duration of the pressure applied to the tobacco, the longer the length of time the tobacco remains in its compressed configuration before expanding again.

In this regard, the compressing and forming means 7 comprise a drum 10 which turns on a respective axis of rotation 10*a* and which is furnished with a plurality of pockets 11 into which the tobacco received from the compacting means 4 is inserted and kept in a compressed state for a certain length of time.

The pockets 11 are filled at a loading station A' which coincides with the unloading station B of the compacting means 4.

The tobacco is compressed and suitably shaped while it is being conveyed from the loading station A' to an unloading station B' coinciding with a pack 9 filling station D.

The drum 10 turns between a pair of mutually opposed walls 12' and 12" delimiting the pockets 11 at the front and rear, closing the access to the front and rear of the pockets 11 during a part of the circular path P of the drum 10, between the loading station A' and the unloading station B'. In effect, the pockets 11 are formed internally of the drum 10 and extend from one face of the drum to the other. Preferably, the pockets 11 are aligned radially, as shown in FIG. 3, and arranged in at least one circular ring 13 which is concentric and coaxial with the drum 10. Advantageously, there are at least two circular rings 13 so that at least two production and packaging lines can be controlled simultaneously.

The pockets 11 are shaped to match the tablet shape imparted to the tobacco: they thus have a three-dimensional shape substantially like that of a parallelepiped, with two opposite faces which are larger than the four elongate lateral faces.

The machine 1 may also comprise a pneumatic system 14, located near the drum 10, between the unloading station B' and the loading station A', along the path P, and serving to clear the pockets 11 of any residual fiber material before they are filled with tobacco again.

The empty packs 9 are supplied to the corresponding feed station 8 through a magazine, not illustrated, containing a plurality of pre-formed packs 9, or by a unit 15 for forming the packs 9.

Figure 2:
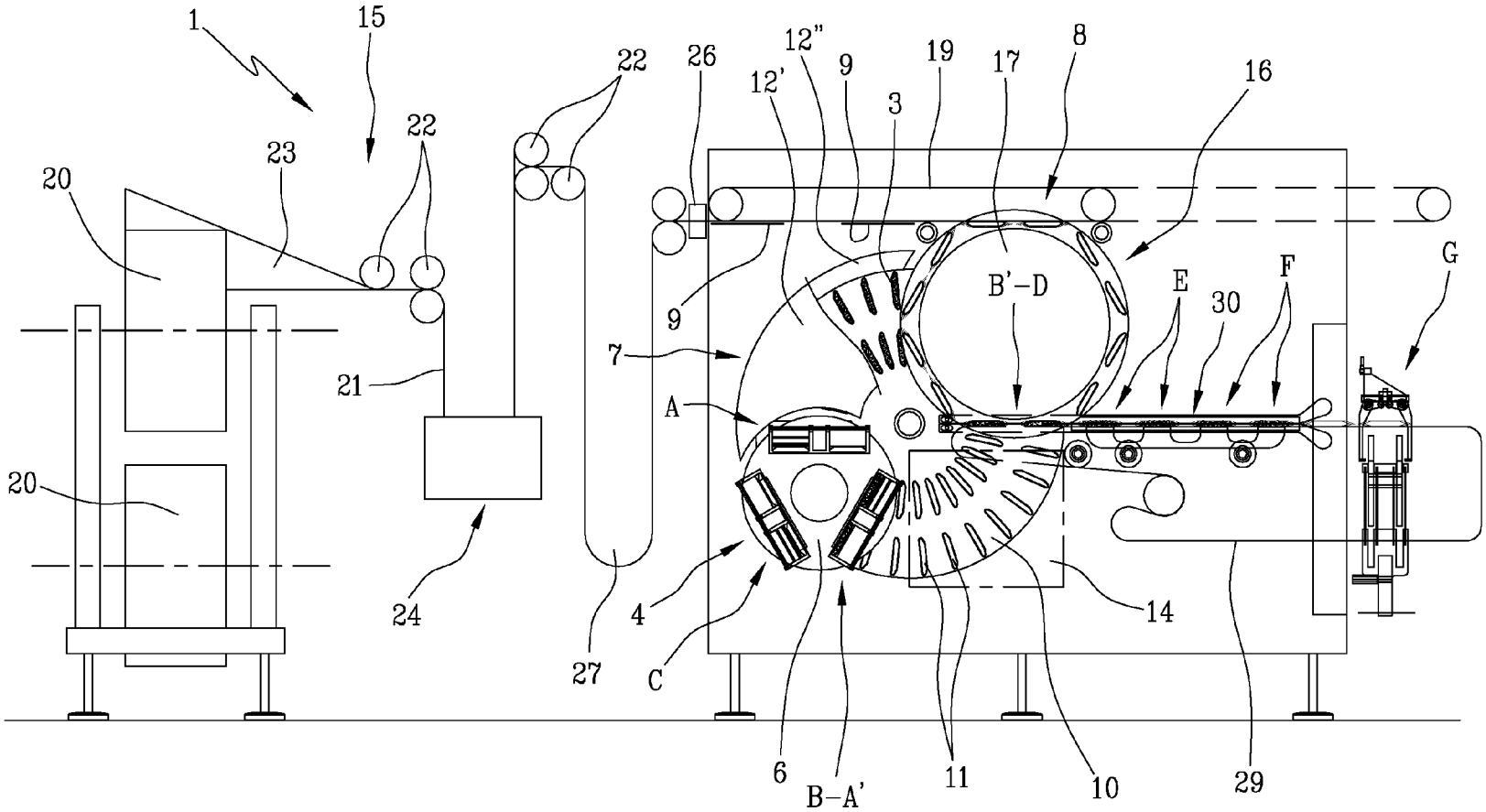
FIG. 2 is a schematic front view of the machine according to this invention.

The unit 15, illustrated schematically in FIGS. 1 and 2, comprises a roll 20 from which is unwound a web 21 of wrapping material that is guided by a plurality of feed and tension rollers 22 towards a folder unit 23 which folds the web partly on itself in such a way as to form a pouch-like containing portion 9*a* and a closing flap 9*b*.

Suitable sealing means, represented schematically as a block 24, located downstream of the folder unit 23, seal the web 21 along sealing lines 25 transversal to the extension of the web so as to seal the lateral edges of the packs 9.

Lastly, downstream of the sealing means, there is a cutting station 26 where the web 21, now folded and sealed, is divided into separate packs 9 to be directed towards the pack 9 feed station 8.

The web 21 unwound from the roll 20 to the cutting station 26 creates a plurality of curves defining a buffer or reservoir 27 of wrapping material.

Advantageously interposed between the pack 9 feed station 8 and the pack 9 filling station D there are suitable pack 9 transfer means 16.

The transfer means 16 comprise a carousel 17 mounted rotatably about a preferably horizontal axis 17*a* and equipped with a plurality of cantilevered carrier elements 18 each serving to hold a single empty pack 9.

Advantageously, the carrier elements 18 are distributed round the periphery of the carousel 17, grouped preferably in pairs, as illustrated in the accompanying drawings, so as to control at least a double production line.

There may, however, be more than two carrier elements 18 in each group, depending on the design and production specifications of the machine 1.

Each carrier element 18 comprises a hollow body of flattened form, shaped in such a way that it can be inserted into the pouch of the respective pack 9, thereby holding the selfsame pack open to allow the insertion of the portion of fiber material 3. Advantageously, the hollow body is equipped with end-mounted blowing means which, by blowing a jet of air, keep the edges 9*c* apart to define the opening of the pouch-like portion 9*a* and thereby assisting the opening of the pack and the insertion of the hollow body thereinto.

From the cutting station 26, the single packs 9 are directed to the feed station 8 by suitable conveying means 19, preferably by a suction belt. Suitable pick-up means—for example, grippers not illustrated—pick up the single packs from the suction belt 19 and place each one on a respective carrier element 18.

As described above, the carousel 17 turns about the axis 17*a* and transports the packs 9 from the feed station 8 which supplies the packs 9 to the filling station D where the compressed tobacco tablets also arrive, each transported in a respective pocket 11 of the compressing and forming means 7.

At the station D, there are further pusher means serving to assist the removal of the tobacco tablet from each pocket 11 and its insertion into a respective pack 9 held by a respective carrier element 18.

Filling each pack 9 is accomplished through the agency of suitable gripper elements which hold the pack 9 while the pusher means push the tobacco out of the respective pocket 11 and into the pack 9, making it pass through the carrier element 18 which keeps the pack open. By their action, the pusher means cause the pack 9, with the tobacco tablet inside it, to slide out of the respective carrier element 18 and to move over a feed device 29 such as a conveyor belt, preferably of the suction type.

Each pack 9, filled with the tobacco tablet and released onto the feed device 29 downstream of the filling station D, goes through a closure station E and from there to a sealing station F.

The closure station E comprises closing means 30 which in turn comprise at least one gripper element 31 that comes into operation immediately after the tablet of fiber material has been inserted into the pack 9, in such a way as to hold together two mutually opposed edges 9*c* along a line located immediately beyond the tablet of fiber material inserted into the pack 9 itself.

In other words, the gripper element 31 presents a pair of mutually opposed bars which move close together in such a way as to hold together the edges 9*c* of the pack opening, along a line located immediately beyond the end of the tablet, in order to close the pouch of the pack 9.

At the sealing station F, the closing means 30 also present a sealing unit 32, which is adjacent to the gripper element 31 and which acts in conjunction with the gripper element to seal the edges of the pack along a line 28 parallel and adjacent to the one defined by the gripper element 31.

Thus, while the gripper element 31 holds together the open edges 9*c* of the pouch, the sealing unit 32 closes the pack by making a seal along a line 28 beyond the gripper element 31 relative to the tobacco tablet.

Advantageously, the sealing unit 32 comprises at least one pair of hot sealers driven by magnets or electromagnets.

Downstream of the sealing station F, there is a folding and labeling unit G designed to fold the flap 9*b* of the pack over the respective pouch 9*a* and to apply a closure tab and a label stamp to the pack 9.

In use, portions of suitably treated and measured fiber material 3 are supplied in ordered succession to the compacting means 4 where each portion of fiber material 3 is initially compacted.

From here, each compacted tobacco portion 3 is inserted into the pockets 11 formed in the compressing and forming means 7 where the tobacco is held in a compressed state for a certain length of time, variable between 10 and 25 seconds, preferably between 13 and 20 seconds.

Next, each tablet thus compacted is inserted into each pack 9 supplied in ordered succession to the feed station 8.

Each pack presents a pouch-like containing portion 9*a* and a closure flap 9*b* foldable over the pouch-like portion.

Once the tobacco tablet has been inserted into the pouch-like containing portion 9*a* of the pack, the edges 9*c* of the pouch are moved close to each other, held together and sealed using hot sealers driven by magnets or electromagnets.

Lastly, the packs thus sealed are directed to the folding and labeling unit G, at which the folding and closure of the pack 9 are completed, and more specifically, at which the flap 9*b* is folded over the pouch 9*a* and label stamps, such as state revenue stamps, are applied.

The invention described above brings important advantages and achieves the above mentioned aims.

The compressing and forming means allow the tobacco to take and keep a compact, tablet-like configuration so that the tablet can be easily inserted into the pack and does not expand immediately. That way, the tablet keeps its compact shape for a certain length of time, allowing the pack to be sealed without tobacco residue getting trapped in the seal and creating the drawbacks typical of the prior art.

Thus, the machine according to this invention and the related method for packaging fiber material, preferably loose tobacco, can guarantee a perfect pack seal, a high level of tobacco protection and extended shelf life.

Moreover, the possibility of having a double feed line, for processing and packaging, allows packaging times to be reduced.

What is claimed is:

1. A machine for packaging fiber material, comprising:

a conveyor supplying predetermined portions of fiber material in an ordered succession, a compacting mechanism by which the portions of fiber material are compacted initially, a feed station to which packs are supplied for filling with the fiber material, a filling station at which the fiber material is inserted into the packs, a closure station located downstream of the filling station, at which the filled packs are sealed, fiber material compressing and forming mechanism by which each of the portions of fiber material is maintained in a state of compression downstream of the compacting mechanism for a prescribed interval of time, such that each of the portions of fiber material is caused to assume a compact geometry of tablet shape prior to insertion into the respective pack;

wherein the compacting mechanism comprises at least one box having a compartment, and a lid hinged to the compartment; the at least one box being constructed and arranged to accommodate a respective portion of fiber material supplied by the conveyor, internally of the compartment, and to compact the portion of fiber material when the lid is closed over the compartment.

2. The machine of claim 1, wherein the compressing and forming mechanism comprises a drum, turning on a respective axis of rotation, including a plurality of pockets into which the portions of fiber material received from the compacting mechanism are inserted at a loading station and conveyed to an unloading station.

3. The machine of claim 2, wherein the pockets are aligned radially and arranged in at least one circular ring which is concentric and coaxial with the drum.

4. The machine of claim 2, wherein the drum rotates, at least in part, between a pair of mutually opposed walls delimiting the pockets at the front and rear.

5. The machine of claim 2, wherein the compressing and forming mechanism comprises a pneumatic system serving to clear the pockets of any residual fiber material along a stretch of a circular path between the unloading station and the loading station, or between the filling station and the loading station.

6. The machine of claim 1, wherein the box includes an open front wall and an open rear wall.

7. The machine of claim 1, wherein the compacting mechanism comprises a support rotatable about a respective axis, and a plurality of boxes mounted to the support; the boxes following a circular path through a loading station at which the portions of fiber material are received from the conveyor, an unloading station at which the portions of fiber material are released to the compressing and forming mechanism, and a reject station at which portions of fiber material can be discarded.

8. The machine of claim 1, further comprising a transfer mechanism by which the packs are transferred from the feed station and directed toward the station at which the packs are filled.

9. The machine of claim 8, wherein the transfer mechanism comprises a carousel rotatable about a horizontal axis and including a plurality of cantilevered carrier elements each serving to hold a single pack.

10. The machine of claim 9, wherein each carrier element comprises a hollow body of flattened form, shaped such that it can be inserted into the respective pack, thereby holding the respective pack open to allow the insertion of the fiber material.

11. The machine of claim 1, wherein the closure station comprises a closing mechanism, operating downstream of the filling station, including at least one gripper element that comes into operation immediately after the tablet of fiber material has been inserted into the pack to hold together two mutually opposed edges delimiting the opening of the pack, along a line located immediately beyond the tablet of fiber material inserted into the pack.

12. A machine for packaging fiber material, comprising:

a conveyor supplying predetermined portions of fiber material in an ordered succession, a compacting mechanism by which the portions of fiber material are compacted initially, a feed station to which packs are supplied for filling with the fiber material, a filling station at which the fiber material is inserted into the packs, a closure station located downstream of the filling station, at which the filled packs are sealed, fiber material compressing and forming mechanism by which each of the portions of fiber material is maintained in a state of compression downstream of the compacting mechanism for a prescribed interval of time, such that each of the portions of fiber material is caused to assume a compact geometry of tablet shape prior to insertion into the respective pack;

wherein the compressing and forming mechanism comprises a drum, turning on a respective axis of rotation, including a plurality of pockets into which the portions of fiber material received from the compacting mechanism are inserted at a loading station and conveyed to an unloading station;

wherein the drum rotates, at least in part, between a pair of mutually opposed walls delimiting the pockets at the front and rear.

* * * * *